US006654566B1

(12) United States Patent
Yamaguchi et al.

(10) Patent No.: US 6,654,566 B1
(45) Date of Patent: Nov. 25, 2003

(54) DEVELOPER AGITATING SYSTEM, ELECTROPHOTOGRAPHIC IMAGE FORMING APPARATUS AND CARTRIDGE

(75) Inventors: Seiji Yamaguchi, Numazu (JP); Masahide Kinoshita, Shizuoka-ken (JP); Motoki Adachi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/585,606

(22) Filed: Jun. 2, 2000

(30) Foreign Application Priority Data

Jun. 10, 1999 (JP) ..... 11-163654
May 25, 2000 (JP) ..... 2000-155061

(51) Int. Cl.[7] ..... G03G 15/00

(52) U.S. Cl. ..... 399/12; 399/13; 399/59; 399/127

(58) Field of Search ..... 399/12, 27, 59, 399/127, 254, 13

(56) References Cited

U.S. PATENT DOCUMENTS

| | | | | |
|---|---|---|---|---|
| 4,585,327 A | * | 4/1986 | Suzuki | 399/12 |
| 4,739,367 A | * | 4/1988 | Watanabe et al. | 399/127 X |
| 4,937,626 A | * | 6/1990 | Kohtani et al. | 399/12 |
| 5,095,335 A | | 3/1992 | Watanabe et al. | 355/210 |
| 5,166,730 A | * | 11/1992 | Urabe | 399/59 |
| 5,235,384 A | * | 8/1993 | Oka et al. | 399/27 |
| 5,548,378 A | * | 8/1996 | Ogata et al. | 399/13 |
| 5,589,918 A | | 12/1996 | Oshida et al. | 399/114 |
| 5,634,174 A | | 5/1997 | Mori et al. | 399/62 |
| 5,682,574 A | | 10/1997 | Oshida et al. | 399/64 |

FOREIGN PATENT DOCUMENTS

| | | | |
|---|---|---|---|
| JP | 62-119564 | * | 5/1987 |
| JP | 7-64452 | * | 3/1995 |
| JP | 8-137238 | * | 5/1996 |
| JP | 11-272063 | * | 10/1999 |

OTHER PUBLICATIONS

Patent Abstracts of Japan, vol. 11, No. 335 (P–632) Nov. 4, 1987 (JP–62–119564).

Patent Abstracts of Japan, vol. 11, No. 313 (P–626) Oct. 13, 1987 (JP–62–103659).

Patent Abstracts of Japan, vol. 1996, No. 9, Sep. 30, 1996 (JP–08–137238).

Patent Abstracts of Japan, vol. 1998, No. 2, Jan. 30, 1998 (JP–09–281786).

* cited by examiner

*Primary Examiner*—Joan Pendegrass
(74) *Attorney, Agent, or Firm*—Fitzpatrick, Cella, Harper & Scinto

(57) ABSTRACT

A developer agitating system for agitating a developer includes a cartridge detachably mountable to a main body of an electrophotographic image forming apparatus and including a developing member for developing an electrostatic latent image formed on an electrophotographic photosensitive member, a developer container for containing the developer used for development of the electrostatic latent image by the developing member, an agitating member for agitating the developer contained in the developer container, and an informing member having information for indicating that the cartridge is a given cartridge, and a detector for detecting the information in the informing member when the cartridge is mounted to the main body of the electrophotographic image forming apparatus. As a result of detecting the information by the detector, if the cartridge is the given cartridge, a period of time of agitating the developer by the agitating member is made longer than that in a case where the cartridge is not the given cartridge.

19 Claims, 7 Drawing Sheets

DEVELOPER AGITATING SYSTEM, ELECTROPHOTOGRAPHIC IMAGE FORMING APPARATUS AND CARTRIDGE

BACKGROUND OF THE INVENTION

Field of the Invention

The present invention relates to a developer agitating system, an electrophotographic image forming apparatus, and a cartridge.

The electrophotographic image forming apparatus forms an image on a recording medium through an electrophotographic image forming process. For example, the electrophotographic image forming apparatus includes an electrophotographic copying machine, an electrophotographic printer, such as an LED printer or a laser beam printer, an electrophotographic facsimile machine, and an electrophotographic word processor.

The process cartridge makes charging means, developing means or cleaning means and an electrophotographic photosensitive member integrally into a cartridge that is detachably mountable to a main body of the electrophotographic image forming apparatus, or makes at least one of the charging means, the developing means and the cleaning means and the electrophotographic photosensitive member integrally into a cartridge that is detachably mountable to the main body of the electrophotographic image forming apparatus, or makes at least the developing means and the electrophotographic photosensitive member integrally into a cartridge that is detachably mountable to the main body of the electrophotographic image forming apparatus.

The developing cartridge is directed to a cartridge that includes at least the developing means and is detachably mountable to the main body of the electrophotographic image forming apparatus.

Up to now, a two-component developing device has been widely employed as an electrophotographic developing device. This is because the electrostatic charging property of the toner is remarkably excellent. FIG. 5 shows an example of a general two-component developing device.

Referring to FIG. 5, a two-component developing device 111 includes a developer container 110 that contains a developer therein and a developing sleeve 102 that serves as a developer bearing member and is rotatably supported on an opening portion of the developer container 110. The developing sleeve 102 is formed of a hollow metal sleeve and surrounds a magnet roller 103 therein.

Also, first and second agitating screws 105 and 106, which serve as agitating means, are disposed within the developer container 110 so as to be substantially in parallel with the developing sleeve 102, and more specifically, the first agitating screw 105 is disposed in the vicinity of the developing sleeve 102, whereas the second agitating screw 106 is disposed far from the developing sleeve 102.

Further, as is understood from FIG. 6, the first and second agitating screws 105 and 106 are partitioned by an inner wall 107 so that the developer is not delivered between both the first and second screws 105 and 106 while the developer is being carried, and the developer can be delivered between the first and second agitating screws 105 and 106 through opening portions defined between both end portions of the inner wall 107 and the developer container 110. Then, because the first and second agitating screws 105 and 106 are so designed as to carry the developer in opposite directions, respectively, a circulating path is produced within the developer container 110, which allows the developer to circulate therein without being interrupted as indicated by arrows.

An inductance sensor 112 for detecting the ratio of non-magnetic toner to magnetic carriers (hereinafter referred to as "toner density") which are formed into a two-component developer is disposed upstream of the second agitating screw 106 in the developer carrying direction as toner density detecting means. Because the permeability of the developer is determined by the amount of carriers contained in a given volume, the toner density can be detected by measuring the permeability of the developer through the inductance sensor 112.

A toner replenishing port 108 is disposed slightly downstream of the inductance sensor 112. When the toner is used for image formation and the toner density in the developer decreases, the decreased amount of the toner density is measured by the inductance sensor 112 when the developer passes through the inductance sensor 112. Then, an appropriate amount of toner is replenished to the developer container 110 through the toner replenishing port 108 from a toner replenishing mechanism 109 mounted on an upper portion of the developer container 110 so that the toner density of the developer is maintained at a constant value.

There are many cases in which the developing device is detachably mountable to a main body of an image forming apparatus as a developing cartridge so that a user per se can replace the developing device by a new one.

Incidentally, the most significant advantage of the developing cartridge (or process cartridge) resides in the fact that the cartridge can be replaced by the user per se. In the most cases, the developing cartridge is kept in its attitude in which the developing cartridge is set within a packaging box. However, in the case where the developing cartridge is kept for a long period of time in a state where the developing cartridge is set vertically as shown in FIG. 7, there is a fear that a developer T is extremely one-sided in its longitudinal direction within the developer container 110.

As a result, there may unavoidably occur disadvantages such that the toner density becomes non-uniform, the replenished toner is not well mixed with the developer, or the like.

The above disadvantages may be applied to not only the developing cartridge but also the process cartridge.

SUMMARY OF THE INVENTION

The present invention has been made in order to solve the above problems, and therefore an object of the present invention is to provide a developer agitating system, an electrophotographic image forming apparatus, and a cartridge that are capable of returning the developer to an appropriate state even if the contained developer is one-sided.

Another object of the present invention is to provide a developer agitating system, an electrophotographic image forming apparatus, and a cartridge, which detect whether there is provided a given cartridge, that is, a cartridge where developer in a developer containing portion is not consumed at all, or not, and agitate the developer for a period of time corresponding to a detected result.

Still another object of the present invention is to provide a developer agitating system, an electrophotographic image forming apparatus, and a cartridge, which detect whether there is provided a given cartridge, that is, a cartridge where developer in a developer containing portion is not consumed at all, or not, and agitate the developer for a long period of time as compared with a case in which the given cartridge is not provided if the given cartridge is provided.

Yet still another object of the present invention is to provide a developer agitating system, an electrophotographic image forming apparatus, and a cartridge, which detect whether there is provided a given cartridge, that is, a cartridge where developer in a developer containing portion is not consumed at all, or not, agitate the developer for a long period of time as compared with a case in which the given cartridge is not provided if the given cartridge is provided, and thereafter measure the density of developer.

Yet still another object of the present invention is to provide a developer agitating system, an electrophotographic image forming apparatus, and a cartridge, which measure the density of developer after agitating the developer, and store the measured density of developer as a standard density in a memory.

Still another object of the present invention is to provide a developer agitating system, an electrophotographic image forming apparatus and a cartridge, which detect whether there is provided a given cartridge, that is, a cartridge where a developer filled in a developer containing portion is not consumed at all, or not, and agitate the developer for a long period of time as compared with a case in which the given cartridge is not provided if the given cartridge is provided.

Yet still another object of the present invention is to provide a developer agitating system, an electrophotographic image forming apparatus and a cartridge, which detect whether there is provided a given cartridge, that is, a cartridge where a developer filled in a developer containing portion is not consumed at all, or not, agitate the developer for a long period of time as compared with a case in which the given cartridge is not provided if the given cartridge is provided, and thereafter measure the density of developer.

Yet still another object of the present invention is to provide a developer agitating system, an electrophotographic image forming apparatus and a These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Now, a description will be given in more detail of an electrophotographic image forming apparatus, a developing cartridge, and a process cartridge in accordance with preferred embodiments of the present invention with reference to the accompanying drawings.

(First Embodiment)

A first embodiment of the present invention will be described with reference to FIGS. 1 to 3 and 8.

Figure 1:
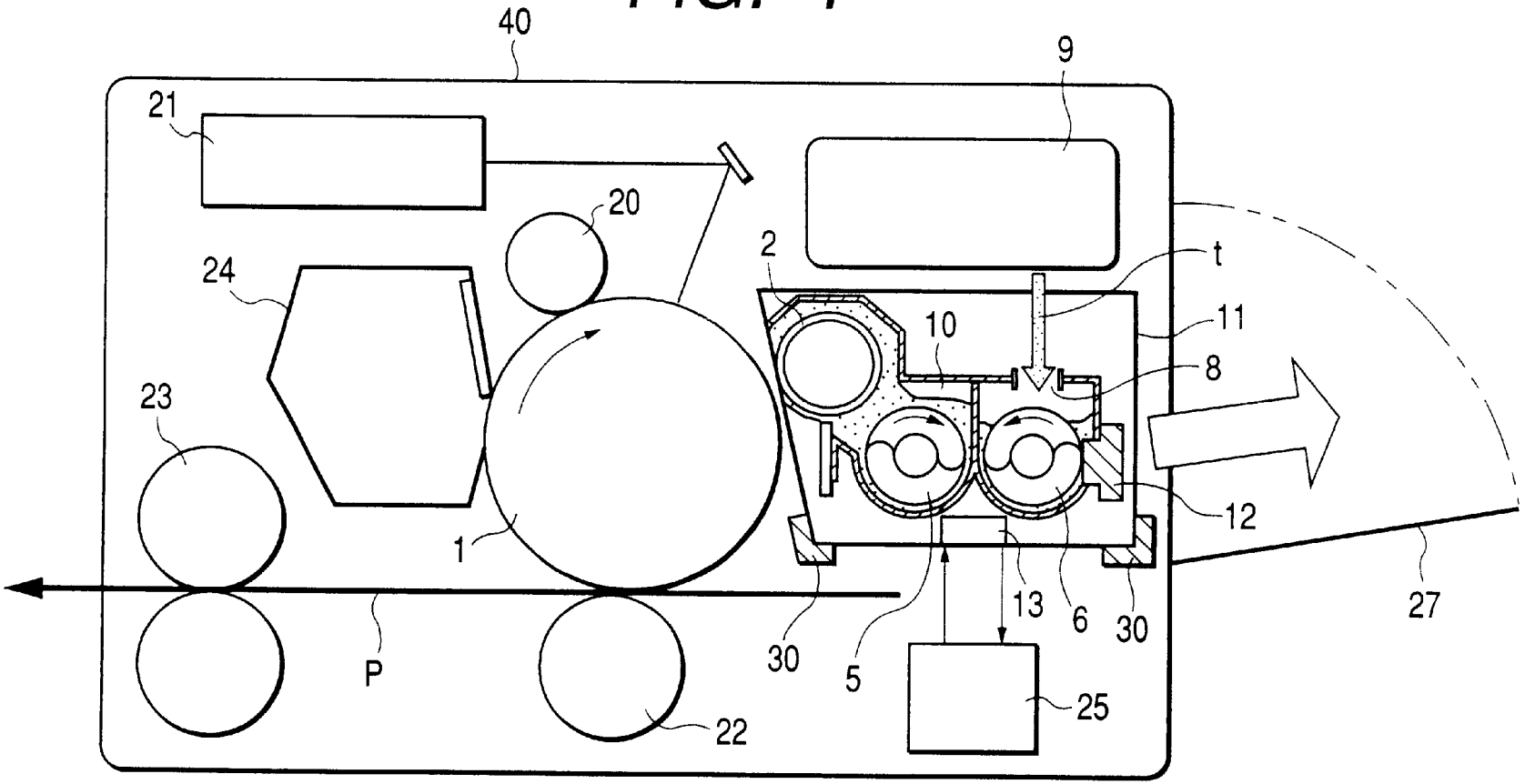
FIG. 1 is a structural diagram showing an electrophotographic image forming apparatus in accordance with first to third embodiments of the present invention.

First, an electrophotographic image forming apparatus according to this embodiment will be described with reference to FIG. 1.

The electrophotographic image forming apparatus includes a drum-shaped electrophotographic photosensitive member (photosensitive drum) 1 which is disposed substantially in the center of the electrophotographic image forming apparatus and rotates in a direction indicated by an arrow, a charging roller 20 serving as a charging member, and a developing cartridge 11 detachably mounted by mounting means 30 through an openable and closable door 27 disposed on an image forming apparatus body 40. The charging roller 20 and the developing cartridge 11 are disposed around the photosensitive drum 1. The electrophotographic image forming apparatus also includes a transfer roller 22 serving as transferring means, and a cleaning blade 24 serving as a cleaning member that removes the developer remaining on the photosensitive drum 1. The electrophotographic image forming apparatus further includes an exposing device 21 that forms an electrostatic latent image on the photosensitive drum 1, a toner replenishing mechanism 9 that supplies toner to the developing cartridge 11, and a fixing device 23.

It should be noted that the developing cartridge 11 is of a so-called replenishment type in this embodiment, but the present invention is also applicable to a developing cartridge 11 which is not of the replenishment type.

In the above-described structure, the surface of the photosensitive drum 1 is uniformly charged by the charging roller 20 to form an electrostatic latent image thereon in accordance with image information by the exposing device 21. The electrostatic latent image is developed into a toner image by the developing cartridge 11. Then, the toner image is transferred onto a recording medium P by the action of the transfer roller 22. Subsequently, the toner image is fixed by the fixing device 23 while the recording medium P is conveyed by the fixing device 23, and then discharged to the exterior of the apparatus.

Figure 2:
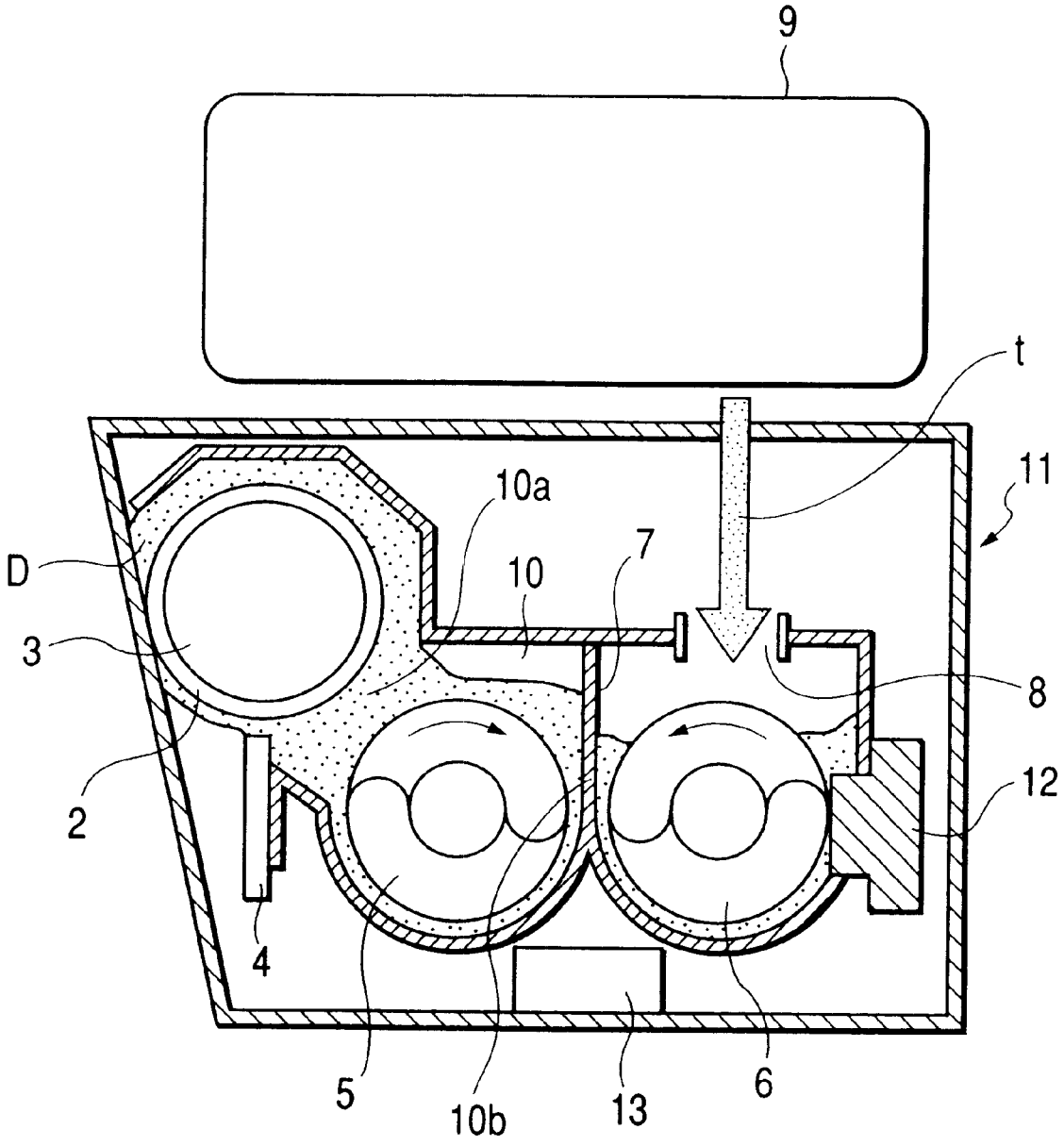
FIG. 2 is a structural diagram showing a developing cartridge in accordance with the first and second embodiments.

Then, the developing cartridge 11 according to this embodiment will be described with reference to FIG. 2.

The developing cartridge 11 according to this embodiment is of a two-component developing device and includes a developer container 10 that serves as a developer containing portion and contains a developer D therein, and a developing roller 2 that serves as a developer bearing member which is rotationally supported on an opening portion 10*a* of the developer container 10. The developing roller 2 is formed of a hollow metal sleeve and surrounds a magnet roller 3 that serves as magnetic field generating means therein.

First and second agitating screws 5 and 6, which serve as agitating means (agitating members), are disposed within the developer container 10 so as to be substantially in parallel with the developing roller 2. More specifically, the first agitating screw 5 is disposed in the vicinity of the developing roller 2, whereas the second agitating screw 6 is disposed far from the developing roller 2.

Also, the first and second agitating screws 5 and 6 are partitioned by an inner wall 7 so that the developer is not delivered between both the first and second screws 5 and 6 on the way the developer is being carried. The developer can be delivered between the first and second agitating screws 5 and 6 through opening portions 10*b* defined between both end portions of the inner wall 7 in its longitudinal direction and the developer container 10. Then, because the first and second agitating screws 5 and 6 are so designed as to carry the developer in opposite directions, respectively, a circulating path is produced within the developer container 10, which allows the developer to circulate therein without being interrupted.

Reference numeral 4 denotes a developing blade which regulates the amount of developer D stuck on the peripheral surface of the developing roller 2.

An inductance sensor 12 that serves as toner density detecting means for detecting the ratio of non-magnetic toner to magnetic carriers (hereinafter referred to as "toner density") which are formed into a two-component developer is disposed upstream of the second agitating screw 6 in the developer carrying direction. The permeability of the developer is determined by the amount of carriers contained in a given volume. For that reason, the toner density can be detected by measuring the permeability of the developer through the inductance sensor 12.

A toner replenishing port 8 is disposed above and slightly downstream ofthe inductance sensor 12. When the toner is used for image formation and the toner density in the developer decreases, the decreased amount of the toner density is measured by the inductance sensor 12 when the developer D passes through the inductance sensor 12. Then, an appropriate amount of toner is replenished into the developer container 10 through the toner replenishing port 8 from a toner replenishing mechanism 9 mounted on an upper portion of the developer container 10 so that the toner density of the developer is maintained at a constant value.

Also, a readable and writable EP-ROM 13 is mounted on the developing cartridge 11 as storing means (memory). When the developing cartridge 11 is mounted on the main body 40 of the image forming apparatus by the mounting means 30, the developing cartridge 11 is electrically connected to a CPU 25, which serves as processing means of the image forming apparatus, through reading and writing means 29 which serves as detecting means. Fresh-cartridge information of the developing cartridge 11 or the like can be read and written from the main body 40 side of the image forming apparatus.

In this embodiment, information on whether the developing cartridge 11 is a given developing cartridge 11, that is, a cartridge in which the developer filled in the developer container 10 is not consumed at all (fresh cartridge), or not, is stored in the EP-ROM 13.

Subsequently, the structure of this embodiment will be described with reference to FIG. 8.

Figure 8:
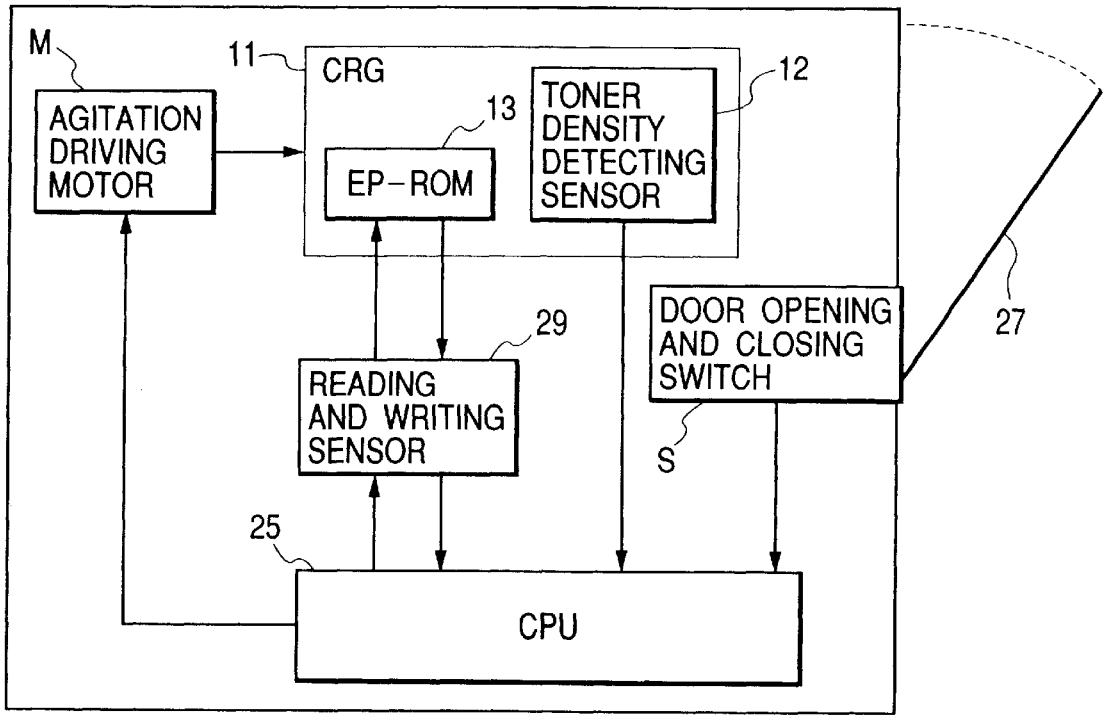
FIG. 8 is a block diagram showing the first and second embodiments.

FIG. 8 is a block diagram schematically showing the input/output of the image forming apparatus and the developing cartridge.

In the main body of the image forming apparatus, there is provided an openable and closable door 27 that serves as an opening and closing member which is employed when the developing cartridge 11 is detached from or attached to the main body. Then, the door 27 is fitted with a switch S which detects the open/close state of the door 27, and its information is transmitted to a CPU which is a central processing unit of the image forming apparatus.

The detected result of the sensor 12 which serves as a toner density detecting sensor and is disposed in the developing cartridge 11 is transmitted to the CPU as the toner density within the developing device 10.

As described above, the developing cartridge 11 is equipped with the EP-ROM 13 which is a readable and writable memory, and the information in the memory 13 is transmitted to the CPU through the reading and writing means 29 disposed in the image forming apparatus.

The CPU conducts various judgements from that information and drives an agitation driving motor M to appropriately drive the agitating device (agitating screws 5 and 6) in the developing cartridge 11.

Figure 9:
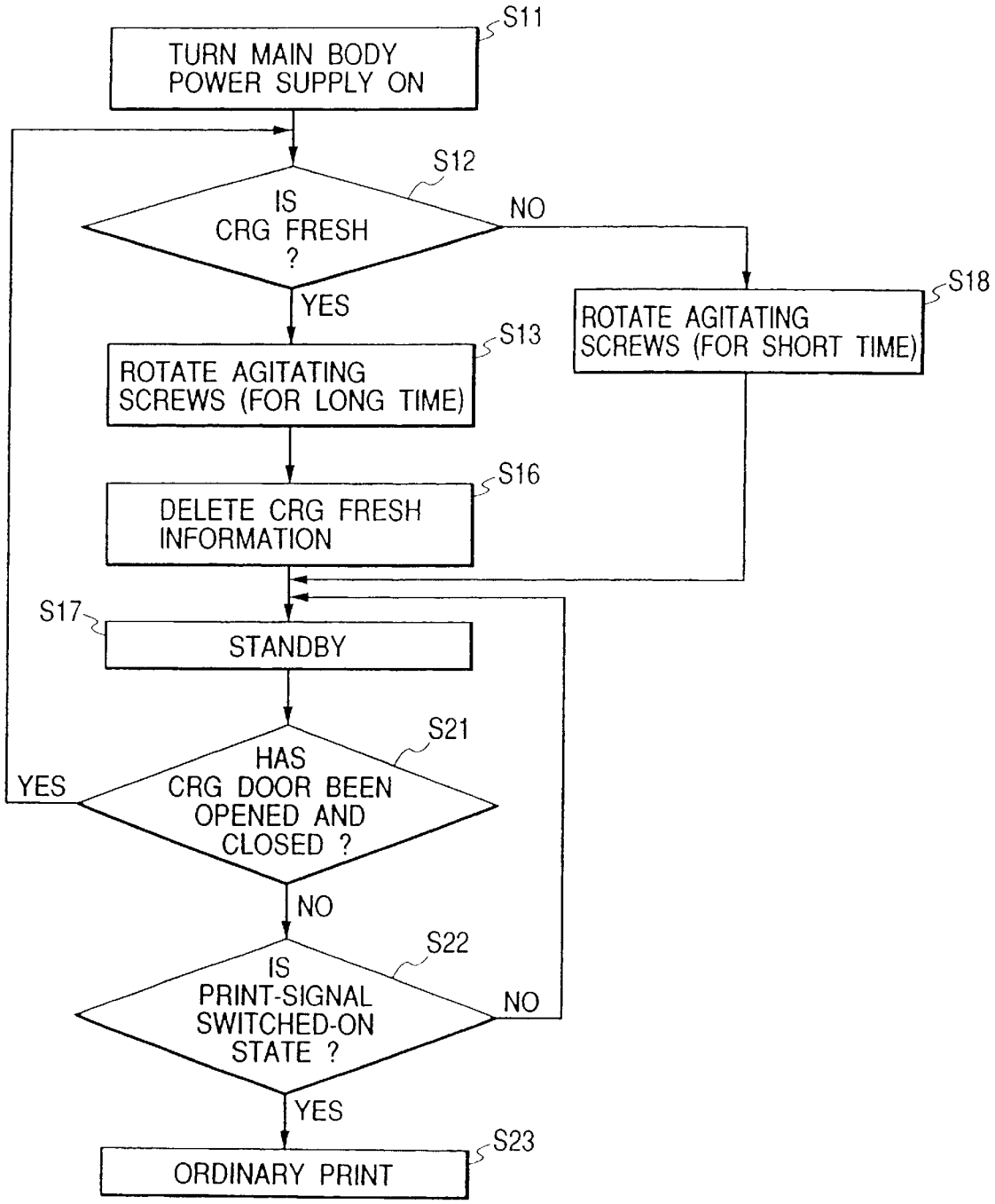
FIG. 9 is a flowchart for explaining the operation of the first embodiment.

Subsequently, the operation of the electrophotographic image forming apparatus according to this embodiment will be described with reference to a flowchart in FIG. 9.

First, after turning on a main body power supply (S11), the engine controller 25 reads the information in the EP-ROM 13 mounted on the developing cartridge 11. Then, the engine controller 25 judges whether the developing cartridge 11 mounted on the main body 40 of the apparatus is a fresh cartridge, or not (S12).

If the engine controller 25 judges that the developing cartridge (CRG) 11 is a fresh cartridge, it starts a fresh-developing device initializing mode. That is, the developing cartridge 11 is first idled for a period of time required to unify the developer and to charge the toner (S13), and the fresh-cartridge information of the developing cartridge is deleted from the EP-ROM 13 (S16). With the above operation, the engine controller 25 completes the fresh-developing device initializing mode and sets the state to a standby state (S17). It is desirable that the fresh-developing device initializing mode is executed, for example, for about 30 to 180 seconds although it depends on the physical properties of the toner and the carriers and the structure of the developing device.

With the execution of the fresh-developing device initializing mode as described above, idling can be sufficiently conducted in advance. Therefore, even if the developer is extremely one-sided, the developer D can be made uniform. Also, a developer in the fresh cartridge is sufficiently agitated within the developing device 10. As a result, the developer and the carriers are well mixed with each other so that the toner can be sufficiently charged. Therefore, the apparatus is ready for the subsequent printing operation in a safe condition.

If the engine controller 25 judges in step S 13 that the developing cartridge 11 is not a fresh cartridge, it starts a developer uniform rotating mode. In this mode, the developing cartridge 11 is idled for a period of time necessary and sufficient to unify the developer (S18). The idling period of time in this mode may be shorter than that in the fresh-developing device initializing mode, and is preferably set to, for example, about 10 to 40 seconds, since it is not particularly important to sufficiently charge the toner. If the, developing device is excessively rotated only for the purpose of unifying the developer, the developer progressively unintentionally deteriorates.

As described above, with the execution of the developer uniform rotating mode, even if the developer within the developing device 10 is completely one-sided to one side during the detaching/attaching operation of the developing cartridge 11, the developer can be returned to a regular state. As a result, there is no disadvantage in the subsequent image formation.

Also, if the developing cartridge attaching and detaching door 27 provided on the main body 40 of the image forming apparatus is opened or closed (S21), the engine controller 25 judges that there is the possibility that the developing cartridge 11 is attached to the main body 40 of the image forming apparatus, and conducts the processing of the steps S12 to S18. Also, if the door 27 is neither opened nor closed, the engine controller 25 judges the on/off state of a print signal (S22) and executes a normal printing operation if the print signal is on (S23), but changes the present state to the standby state if there is no print signal (S17).

As described above, in this embodiment, two modes are provided for the operation conducted after the developing cartridge 11 has been mounted on the main body 40 of the image forming apparatus. Then, if the developing cartridge is a fresh cartridge, the fresh developing device initializing mode is executed whereas if the developing cartridge is not a fresh cartridge, the developer uniform rotating mode is executed, to thereby conduct an appropriate operation according to the respective states of the developing cartridge.

(Second Embodiment)

A second embodiment of the present invention will be described. Since the references and structure of the apparatus are identical with those in the first embodiment, their duplex description will be omitted.

In this embodiment, EP-ROM 13 contains two pieces of information consisting of information on whether the developing cartridge 11 is a fresh cartridge, or not, and information on the density of developer (standard value) when the developing cartridge is fresh.

Figure 3:
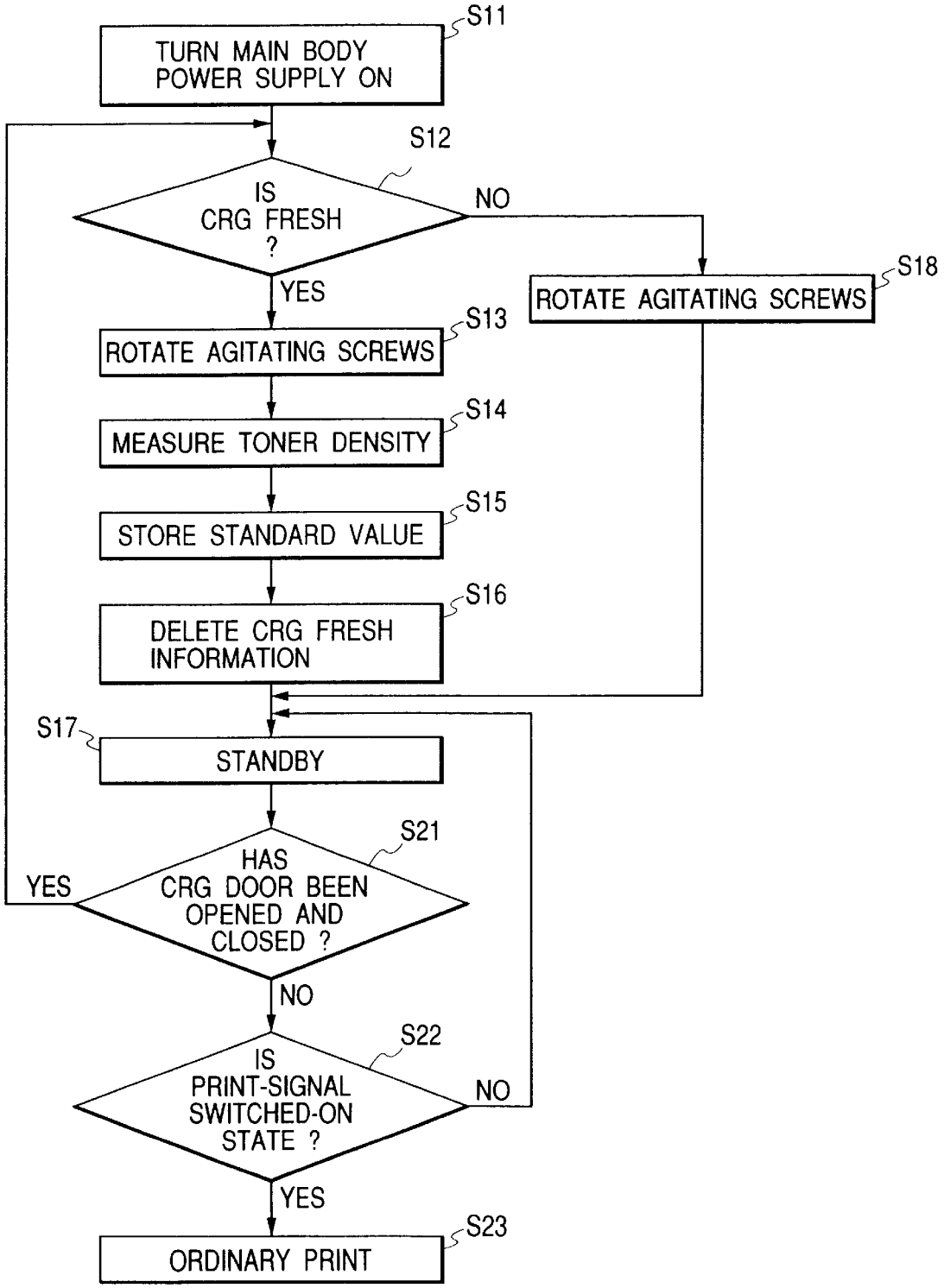
FIG. 3 is a flowchart for explaining the operation of the first and second embodiments.

Subsequently, the operation of the electrophotographic image forming apparatus according to this embodiment will be described with reference to a flowchart shown in FIG. 3.

First, after turning on a power supply of the main body of the apparatus (S11), the engine controller 25 reads the information in the EP-ROM 13 installed on the developing cartridge 11. Then, the engine controller 25 judges whether the developing cartridge 11 mounted on the main body 40 of the apparatus is a given developing cartridge 11, that is, a cartridge where the developer filled in the developer containing portion 10 is not consumed at all (a fresh cartridge), or not (S12).

If the engine controller 25 judges that the developing cartridge 11 is a fresh cartridge, it starts a standard-value setting mode. That is, the developing cartridge 11 is first idled for a period of time required to unify the developer and to charge the toner (S13). Thereafter, the density of the standard developer which is contained in a fresh developing cartridge 11 and adjusted to a given toner density in advance is measured by an inductance sensor 12 (S14). The measured value is stored as a standard value in the EP-ROM 13 of the developing cartridge 11 (Sl5). If the standard value has been completely stored without any problems, the fresh-cartridge information of the developing cartridge is deleted from the EP-ROM 13 (S16). With the above operation, the standard-value setting mode is completed into the standby state (S17).

In the present specification, the standard-value measuring mode of the toner density is as follows:

The standard developer adjusted to a given toner density in advance is contained in the fresh developing cartridge. When the fresh developing cartridge is mounted on the image forming apparatus, the first agitating screw 5 and the second agitating screw 6 are rotated for a given period of time, and the developer is uniformly shared between those first and second agitating screws 5 and 6 as described above. Then, when the circulation of the developer enters the stationary state, and the charging amount of the toner is also stable, the toner density is measured by the toner density detecting means.

The value thus measured is stored in storing means (for example, EP-ROM) installed on the developing cartridge and set as the toner density standard value inherent to the developing cartridge. In a normal toner density control, the measured value is compared with the standard value to obtain a difference therebetween, thereby being capable of knowing how the present toner density is deviated from the standard developer. As a result, the amount of toner to be replenished can be calculated by the toner replenishing mechanism 9.

With the execution of the standard-value setting mode as described above, the standard value necessary for the subsequent density control can be given to the respective developing cartridges. Accordingly, the density control can be conducted with more accuracy. Also, even if the developer is extremely one-sided, the idling is sufficiently conducted in advance so that the developer can be made uniform. Also, the toner can be sufficiently charged. For that reason, the apparatus is ready for the subsequent printing operation in a safe condition.

If the engine controller 25 judges in step S12 that the developing cartridge 11 is not a fresh cartridge, it starts a developer uniform rotating mode. In this mode, the developing cartridge 11 is idled for a period of time necessary and sufficient to unify the developer (S18). The idling period of time in this mode may be shorter than that in the standard-value setting mode, and is preferably set to, for example, about 10 to 40 seconds. If the developing device (the agitating screws 5 and 6) is excessively rotated only for the purpose of unifying the developer, the developer progressively unintentionally deteriorates.

As described above, with the execution of the developer uniform rotating mode, even if the developer within the developing device 10 is completely one-sided to one side during the detaching/attaching operation of the developing cartridge 11, the developer can be returned to a regular state. As a result, there is no disadvantage in the subsequent image formation.

Also, if the developing cartridge attaching and detaching door 27 provided on the main body 40 of the image forming apparatus is opened or closed (S21), there is the possibility that the developing cartridge 11 is attached to or detached from the main body 40 of the image forming apparatus. For that reason, the processing of the steps S12 to S18 is conducted. Also, if the door 27 is neither opened nor closed, the engine controller 25 judges the on/off state of a print signal (S22) and executes an ordinary printing operation if the print signal is on (S23). On the other hand, the engine controller 25 changes the present state to the standby state if there is no print signal (S17).

As described above, in this embodiment, two modes are provided for the operation conducted after the developing cartridge 11 has been mounted on the main body of the image forming apparatus. Then, if the developing cartridge is a fresh cartridge, the standard-value measuring mode is executed, whereas if the developing cartridge is not a fresh cartridge, the developer uniform rotating mode is executed. As a result, appropriate operation can be conducted according to the respective states of the developing cartridge.

(Third Embodiment)

Figure 4:
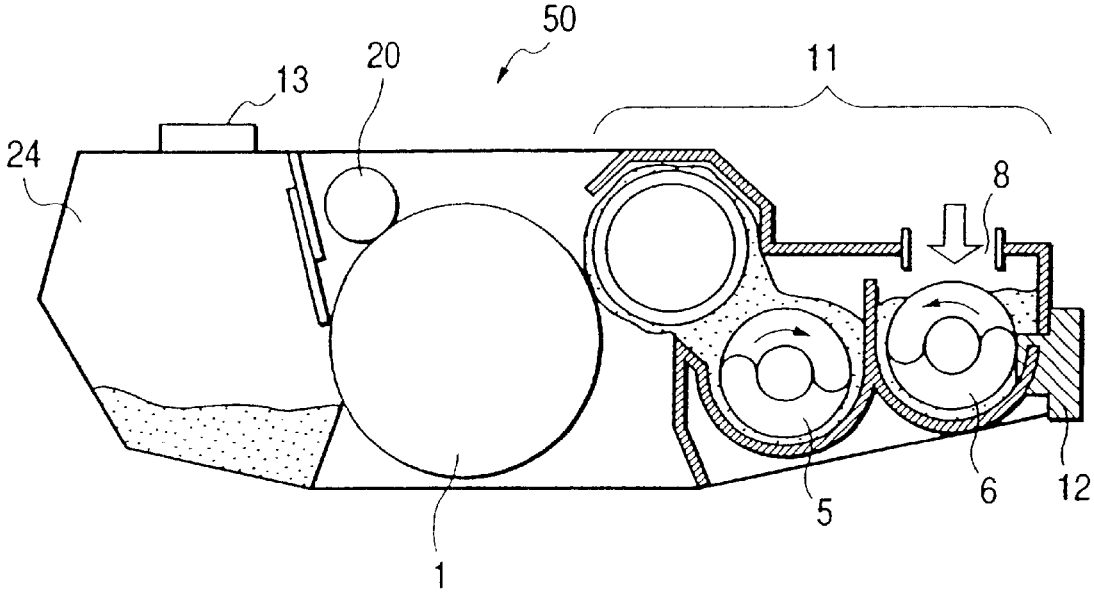
FIG. 4 is a structural diagram showing a process cartridge in accordance with the third embodiment.
Figure 5:
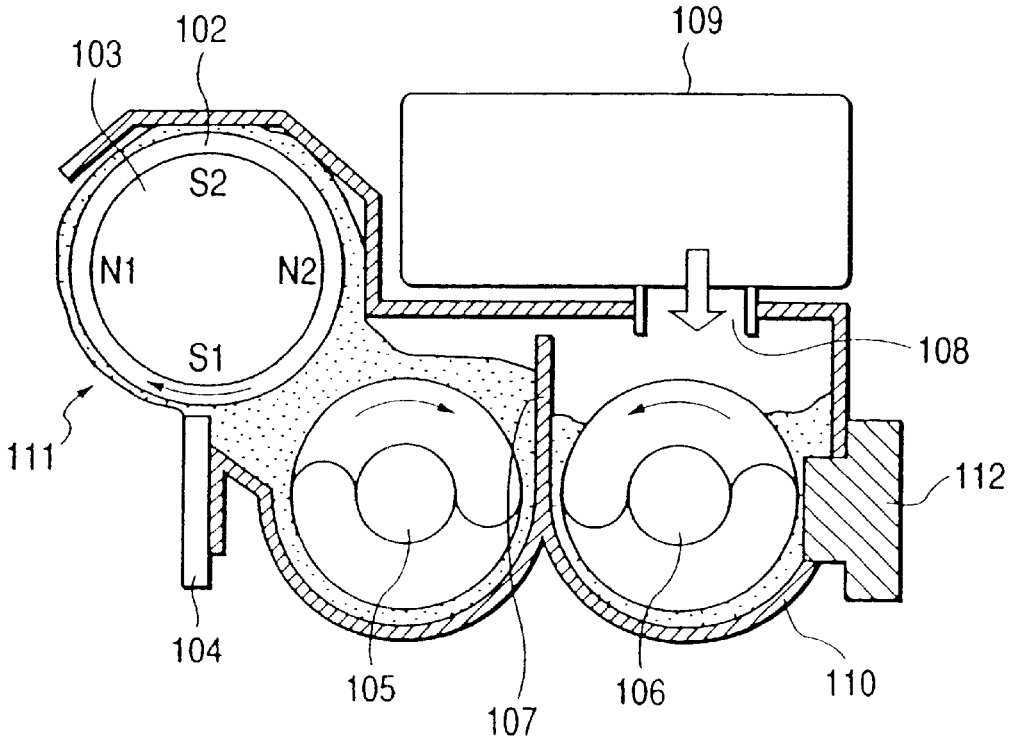
FIG. 5 (PRIOR ART)
FIG. 5 is a structural diagram showing an example of a conventional developing cartridge.
Figure 6:
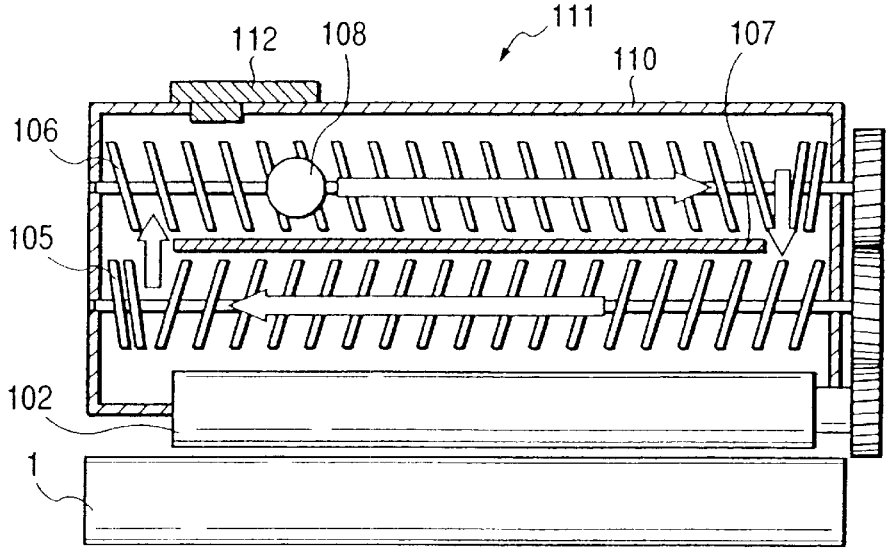
FIG. 6 (PRIOR ART)
FIG. 6 is an explanatory diagram showing a developer circulating state within the developing cartridge shown in FIG. 5.
Figure 7:
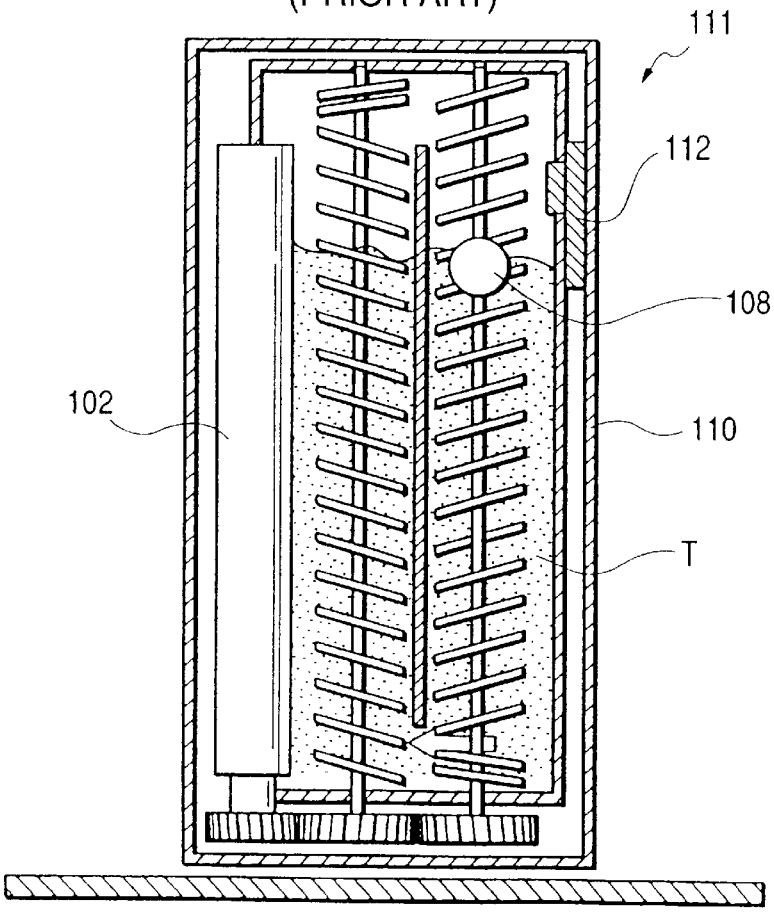
FIG. 7 (PRIOR ART)
FIG. 7 is an explanatory diagram showing a state in which the developing cartridge shown in FIG. 5 is set vertically.

Subsequently, a third embodiment of the present invention will be described with reference to FIG. 4. In the first embodiment, the present invention is applied to the developing cartridge. However, in this embodiment. the present invention is applied to a process cartridge.

In this embodiment, the developing cartridge 11 shown in the first embodiment and the second embodiment, that is, the developing means is integrated with the photosensitive drum 1, the charging roller 20 serving as process means which acts on the photosensitive drum 1 and the cleaning device 24 to be made into a process cartridge (CRG) 50. The process cartridge 11 is detachably mountable to a main body 40 of the image forming apparatus through mounting means (not shown).

Since the developing means 11 in this embodiment is identical with the developing cartridge in the first embodiment, the above description will be applied.

In this embodiment, as in the above-described second embodiment, two modes are provided for the operation conducted after the process cartridge 50 has been mounted on the main body 40 of the image forming apparatus. That is, if the process cartridge 50 is a given process cartridge 50, that is a cartridge where the developer filled in the developer containing portion 10 is not consumed at all (fresh process cartridge), the standard-value measuring mode is executed. On the other hand, if the process cartridge 50 is not a fresh process cartridge, the developer uniform rotating mode is executed. As a result, an appropriate operation can be conducted according to the respective states of the process cartridge.

With the above-described structure, the advantages described in the second embodiment can be obtained. In addition, the structural components of the process cartridge can be readily replaced by new ones. Therefore, the maintenance of the image forming apparatus can be remarkably improved.

In the above-described embodiments, a description was given of a case in which a single developing cartridge or a single process cartridge is employed. However, it is needless to say that the present invention is applicable to a multi-color image forming apparatus or a full-color image forming apparatus in which a plurality of developing cartridges or process cartridges are mounted.

Also, the above-described first embodiment is applicable to the above process cartridge 50.

The above-described respective embodiments are summarized as follows:

There is provided a developer agitating system for agitating a developer D, comprising:

(a) a cartridge detachably mountable to a main body 40 of an electrophotographic image forming apparatus and including a developing member (developing roller 2) for developing an electrostatic latent image formed on an electrophotographic photosensitive member 1, a developer container 10 for containing the developer D used for development of the electrostatic latent image by the developing member, an agitating member (agitating screws 5 and 6) for agitating the developer D contained in the developer container, and an informing member (memory 13) having information for informing that the cartridge is a given cartridge (developing cartridge 11, process cartridge 50); and (b) detecting means (reading and writing means 29) for detecting the information in the informing member 13 when the cartridge 11, 50 is mounted on the main body 40 of the electrophotographic image forming apparatus;

(c) wherein as a result of detecting the information by said detecting means 20, if the cartridge 11, 50 is the given cartridge, a period of time of agitating the developer D by the agitating member 5, 6 is made longer than that in a case where the cartridge is not the given cartridge.

Also, there is provided an electrophotographic image forming apparatus to which a cartridge 11, 50 is detachably mountable for forming an image on a recording medium, the apparatus comprising:

(a) a cartridge 11, 50 detachably mountable to a main body 40 of the electrophotographic image forming apparatus and including a developing member 2 for developing an electrostatic latent image formed on an electrophotographic photosensitive member 1, a developer container 10 for containing a developer D used for development of the electrostatic latent image by the developing member 2, an agitating member 5, 6 for agitating the developer D contained in the developer container 10, and an informing member 13 having information for informing that the cartridge is a given cartridge 11, 50;

(b) detecting means 29 for detecting the information in the informing member 13 when the cartridge 11, 50 is mounted on the main body 40 of the electrophotographic image forming apparatus; and (c) agitating time control means for making a period of time of agitating the developer D by the agitating member 5, 6 longer than that in a case where the cartridge 11, 50 is not the given cartridge, if the cartridge 11, 50 is the given cartridge 11, 50 as a result of detecting the information by the detecting means 20.

Further, there is provided a cartridge 11, 50 detachably mountable to a main body 40 of an electrophotographic image forming apparatus, said cartridge comprising:

a developing member 2 for developing an electrostatic latent image formed on an electrophotographic photosensitive member 1;

a developer container 10 for containing a developer D used for development of the electrostatic latent image by the developing member 2;

an agitating member 5, 6 for agitating the developer D contained in the developer container 10; and an informing member 13 having information for informing that the cartridge is a given cartridge 11, 50;

wherein if the main body 40 of the electrophotographic image forming apparatus detects that the cartridge 11, 50 is the given cartridge 11, 50 when the cartridge 11, 50 is mounted on the main body 40 of the electrophotographic image forming apparatus, a period of time of agitating the developer D by the agitating member 5, 6 is made longer than that in a case where the cartridge 11, 50 is not the given cartridge.

In the above structure, the developer D may be made of a two-component developer, and if the cartridge 11, 50 is the given cartridge, after the developer D is agitated by the agitating member 5, 6 for a period of time longer than that in a case where the cartridge 11, 50 is not the given cartridge, the density of the two-component developer is detected, and the detected density of the developer D is stored in a memory 13 as a standard density.

Also, the memory 13 may be installed in the cartridge 11, 50.

Further, the informing member may be a flag provided in the memory 13.

Still further, the agitating operation may be conducted before the printing operation is a conducted and after an openable and closable member (door 27) disposed in the main body 40 of the electrophotographic image forming apparatus is closed, and before the printing operation is conducted and after power is supplied to the main body 40 of the electrophotographic image forming apparatus.

If the cartridge 11, 50 is the given cartridge, the agitating operation may be conducted for 30 to 180 seconds, but if the cartridge 11, 50 is not the given cartridge, the agitating operation may be conducted for 10 to 40 seconds.

The given cartridge 11, 50 may be a cartridge in which the developer D filled in the developer container 10 is not consumed at all.

The cartridge may comprise a developing cartridge 11 or the cartridge may comprise a process cartridge 50 integrated with the electrophotographic photosensitive member.

The process cartridge 50 may further include at least one of a charging member (charging roller 20) for charging the electrophotographic photosensitive member 1 and a cleaning member (cleaning blade 24) for removing the developer D remaining on the electrophotographic photosensitive member 1.

Also, the informing member is not limited to the above-described memory, but may be formed of, for example, a projection provided on an outer wall of the cartridge 11, 50. Then, the projection is bent after it turns on a switch disposed as the detecting means in the main body of the electrophotographic image forming apparatus when the cartridge 11, 50 is initially mounted on the main body 40 of the electrophotographic image forming apparatus.

Further, in the above-described respective embodiments, a description was given of an example in which the given cartridge (developing cartridge or process cartridge) is a fresh cartridge. However, the present invention is not limited to the fresh cartridge, but is applicable to, for example, a recycled cartridge.

As was described above, according to the present invention, if the cartridge is a given cartridge, the period of time of agitating the developer can be made longer than that in a case in which the cartridge is not the given cartridge.

As a result, even if the cartridge is the given cartridge, the one-sided state of the developer can be canceled.

While the invention has been described with reference to the structures disclosed herein, it is not confined to the details set forth and this application is intended to cover such modifications or changes as may come within the purposes of the improvements or the scope of the following claims.

What is claimed is:

1. A developer agitating system for agitating a developer, comprising:

(a) a cartridge detachably mountable to a main body of an electrophotographic image forming apparatus, said cartridge including a developing member for developing an electrostatic latent image formed on an electrophotographic photosensitive member, a developer containing portion for containing the developer used for development of the electrostatic latent image by said developing member, a plurality of agitating members for agitating and carrying the developer contained in said developer containing portion, and a memory for storing information indicating that the cartridge is a fresh cartridge; and (b) detecting means for detecting said information stored in said memory after power to said main body is turned on and after an openable and closable member provided on said main body to be opened for mounting and detaching of said cartridge is closed, wherein said system operates in a first mode in which, when said information detected by said detecting means indicates that said cartridge is the fresh cartridge, said plurality of agitating members agitates and carries the developer for a predetermined period of time, and wherein said system operates in a second mode in which, when said detecting means detects that said cartridge is not the fresh cartridge, said plurality of agitating members agitates and carries the developer for a period of time shorter than said predetermined period of time.

2. The developer agitating system as claimed in claim 1, wherein the developer is made of a two component developer including toner and carrier, and wherein, in said first mode, after the density of the developer is detected by a density sensor, the detected density is stored as a standard density in said memory, wherein said density sensor is disposed upstream of a replenishing port, for replenishing the toner, provided in said developer containing portion and downstream of said developing member in a carrying direction in which the developer is agitated and carried by said plurality of agitating members.

3. The developer agitating system as claimed in claim 2, wherein, in said first mode, after said standard density is stored in said memory, said memory stores data indicating that said cartridge is not the fresh cartridge.

4. The developer agitating system as claimed in any one of claims 1, 2, or 3, wherein said predetermined period of time for agitating and carrying in said first mode is from 30 to 180 seconds.

5. The developer agitating system as claimed in any one of claims 1, 2, or 3, wherein said period of time for agitating and carrying in said second mode is from 10 to 40 seconds.

6. The developer agitating system as claimed in claim 1, wherein said cartridge is a process cartridge integrally incorporating said electrophotographic photosensitive member.

7. The developer agitating system as claimed in claim 1, wherein said plurality of agitating members are disposed substantially parallel to said developing member.

8. An electrophotographic image forming apparatus to which a cartridge is detachably mountable for forming an image on a recording medium, said electrophotographic image forming apparatus comprising:

(a) mounting means for detachably mounting the cartridge, the cartridge including a developing member for developing an electrostatic latent image formed on an electrophotographic photosensitive member, a developer containing portion for containing a developer used for development of the electrostatic latent image by said developing member, a plurality of agitating members for agitating and carrying the developer contained in said developer containing portion, and a memory for storing information indicating that the cartridge is a fresh cartridge;

(b) an openable and closable member to be opened for mounting and detaching of the cartridge; and (c) detecting means for detecting said information stored in said memory after power to a main body of said electrophotographic image forming apparatus is turned on and after said openable and closable member is closed, wherein said apparatus operates in a first mode in which, when said information detected by said detecting means indicates that the cartridge is the fresh cartridge, said plurality of agitating members agitates and carries the developer for a predetermined period of time, and wherein said apparatus operates in a second mode in which, when said detecting means detects that said cartridge is not the fresh cartridge, said plurality of agitating members agitates and carries the developer for a period of time shorter than said predetermined period of time.

9. The electrophotographic image forming apparatus as claimed in claim 8, wherein the developer is made of a two-component developer including toner and carrier, and wherein, in said first mode, after the density of the developer is detected by a density sensor, the detected density is stored as a standard density in said memory, wherein said density sensor is disposed upstream of a replenishing port, for replenishing the toner, provided in said developer containing portion and downstream of said developing member in a carrying direction in which the developer is agitated and carried by said plurality of agitating members.

10. The electrophotographic image forming apparatus as claimed in claim 9, wherein, in said first mode, after said standard density is stored in said memory, said memory stores data indicating that the cartridge is not the fresh cartridge.

11. The electrophotographic image forming apparatus as claimed in any one of claims 8, 9, or 10, wherein said predetermined period of time for agitating and carrying in said first mode is from 30 to 180 seconds.

12. The electrophotographic image forming apparatus as claimed in any one of claims 8, 9, or 10, wherein said period of time for agitating and carrying in said second mode is from 10 to 40 seconds.

13. The electrophotographic image forming apparatus as claimed in claim 8, wherein said plurality of agitating members are disposed substantially parallel to said developing member.

14. A process cartridge detachably mountable to a main body of an electrophotographic image forming apparatus, said main body including: an openable and closable member to be opened for mounting and detaching of said process cartridge; and detecting means for detecting information, said apparatus operating in a first mode in which, when said information indicates that said cartridge is a fresh cartridge, developer of said cartridge is agitated and carried for a predetermined period of time, and said apparatus operating in a second mode in which, when said detecting means detects that said cartridge is not the fresh cartridge, the developer is agitated and carried for a period of time shorter than said predetermined period of time, said process cartridge comprising:

(a) an electrophotographic photosensitive member;

(b) a developing member for developing an electrostatic latent image formed on said electrophotographic photosensitive member;

(c) a developer containing portion for containing the developer used for development of the electrostatic latent image by said developing member;

(d) a memory for storing said information indicating that said cartridge is the fresh cartridge, said information stored in said memory being detected by said detecting means after power to said main body is turned on and after said openable and closable member is closed; and (e) a plurality of agitating members for agitating and carrying the developer for the period of time corresponding to said first mode or said second mode.

15. The cartridge as claimed in claim 14, wherein the developer is made of a two-component developer including toner and carrier, and wherein, in said first mode, after the density of the developer is detected by a density sensor, the detected density is stored as a standard density in said memory, wherein said density sensor is disposed upstream of a replenishing port, for replenishing the toner, provided in said developer containing portion and downstream of said developing member in a carrying direction in which the developer is agitated and carried by said plurality of agitating members.

16. The cartridge as claimed in claim 15, wherein, in said first mode, after said standard density is stored in said memory, said memory stores data indicating that said cartridge is not the fresh cartridge.

17. The cartridge as claimed in any one of claims 14, 15, or 16, wherein said agitating and carrying period of time in said first mode is from 30 to 180 seconds.

18. The cartridge as claimed in any one of claims 14, 15, or 16, wherein said agitating and carrying period of time in said second mode is from 10 to 40 seconds.

19. The cartridge as claimed in claim 14, wherein said plurality of agitating members are disposed substantially parallel to said developing member.

* * * * *

UNITED STATES PATENT AND TRADEMARK OFFICE

CERTIFICATE OF CORRECTION

PATENT NO. : 6,654,566 B1 
DATED : November 25, 2003
INVENTOR(S) : Seiji Yamaguchi et al.

It is certified that error appears in the above-identified patent and that said Letters Patent is hereby corrected as shown below:

Column 1,
Line 51, “in” should be deleted.

Column 2,
Line 32, “its attitude” should read -- the attitude --.

Column 3,
Lines 18-38, lines 18 through 38 should be deleted.
Line 39, before “These and other objects” insert the paragraph:
-- Yet still another object fo the present invention is to provide a developer agitating system, an electrophotographic image forming apparatus and a cartridge, which agitate a two-component developer. --

Column 4,
Line 63, “in” should be deleted.

Column 5,
Line 8, “so designed” should read -- designed so --.
Line 27, “ofthe” should read -- of the --.

Column 6,
Line 45, “S 13” should read -- S13” --.

Column 8,
Line 62, “embodiment.” should read -- embodiment, --.

UNITED STATES PATENT AND TRADEMARK OFFICE

CERTIFICATE OF CORRECTION

PATENT NO. : 6,654,566 B1
DATED : November 25, 2003
INVENTOR(S) : Seiji Yamaguchi et al.

It is certified that error appears in the above-identified patent and that said Letters Patent is hereby corrected as shown below:

Column 9,
Line 13, “is” should read -- is, --.
Line 57, “tus;” should read -- tus, --.

Signed and Sealed this

First Day of June, 2004

JON W. DUDAS
*Acting Director of the United States Patent and Trademark Office*